United States Patent [19]

Kistner

[11] 4,359,241

[45] Nov. 16, 1982

[54] DRUM HOLDER

[76] Inventor: Kenneth Kistner, P.O. Box 132A, Delta, Ohio 43515

[21] Appl. No.: 205,460

[22] Filed: Nov. 10, 1980

[51] Int. Cl.[3] ..... B66C 1/14

[52] U.S. Cl. ..... 294/78 R; 294/90

[58] Field of Search ..... 294/15, 16, 31 R, 67 DA, 294/67 DB, 78 R, 78 A, 81 R, 86 R, 90, 103 R, 104, 106, 111–113, 164

[56] References Cited

U.S. PATENT DOCUMENTS

| | | | |
|---|---|---|---|
| 831,424 | 9/1906 | Fravel | 294/78 R |
| 1,295,018 | 2/1919 | Erickson | 294/106 |
| 2,576,193 | 11/1951 | Reynolds | 294/106 |
| 2,696,317 | 12/1954 | Toffolon | 294/67 DA X |
| 3,488,079 | 1/1970 | Stinchfield | 294/78 R |
| 3,915,488 | 10/1975 | Anderson | 294/90 |

FOREIGN PATENT DOCUMENTS

| | | | |
|---|---|---|---|
| 92247 | 5/1938 | Sweden | 294/78 R |

*Primary Examiner*—Johnny D. Cherry

*Attorney, Agent, or Firm*—Emch, Schaffer & Schaub

[57] ABSTRACT

An improved drum handling implement having two arms connected to a central collar at a fixed angle relative to one another, preferably at 120°. Hooks are attached to the ends of each arm. A third hook is connected to a flexible member which extends through the collar and upwardly to a lifting ring.

6 Claims, 5 Drawing Figures

DRUM HOLDER

BACKGROUND OF THE INVENTION

This invention relates to load handling and hoisting implements and more particularly to an improved implement for grasping a barrel or drum to facilitate lifting and transferring the drum.

Many industrial liquids are commonly shipped in barrels or drums. In many parts of the world, for example, liquids are often shipped in 55 gallon drums having standard dimensions. Such drums, when full of liquid, are quite difficult to handle since they may weigh on the order of 400 pounds to 700 pounds, or more. The drums are quite difficult to handle with conventional equipment, such as cranes or forklift trucks since there is no convenient way to grasp a drum. One implement which has been available in the past for grasping a drum is in the form of tongs which are similar to ice tongs. The tongs engage an upper rim on the drum at diametrically opposing locations and are attached to either a hoist cable or to one tine of a forklift. However, implements of this type are quite dangerous since they tend to slip off of the drum, particularly if a workman does not carefully locate the tongs on diametrically opposing portions of the drum rim. Due to the danger of tongs slipping from the drum, many delivery men will not permit the use of this type of implement for loading and unloading their trucks.

SUMMARY OF THE INVENTION

According to the present invention, an improved implement is provided for grasping the upper rim of a barrel or drum, such as a 55 gallon drum, to facilitate lifting the drum from a single point, such as with a hoist cable or from one tine of a forklift. The implement includes two arms attached to a tubular collar to extend at a fixed angle of, preferably, 120°. A hook is attached to the end of each arm for engaging two spaced apart points on the drum rim. A third hook engages a third spaced point on the drum rim, preferably 120° from the other two points, and is connected to a flexible member. The flexible member extends to and upwardly through the collar for attachment to the hoist cable. As the hoist pulls on the flexible member to lift the drum, the hooks firmly engage the rim of the drum to prevent the drum from slipping from the implement. By spacing the three hooks at approximately 120° apart around the rim of the drum, the drum is prevented from slipping from the implement, thereby eliminating the hazard present with the prior art tong type lifting implements.

Accordingly, it is an object of the invention to provide an improved implement for lifting drums, barrels, and the like from a single point.

Other objects and advantages of the invention will become apparent from the following detailed description, with reference being made to the accompanying drawings.

DESCRIPTION OF THE PREFERRED EMBODIMENT

Figure 1:
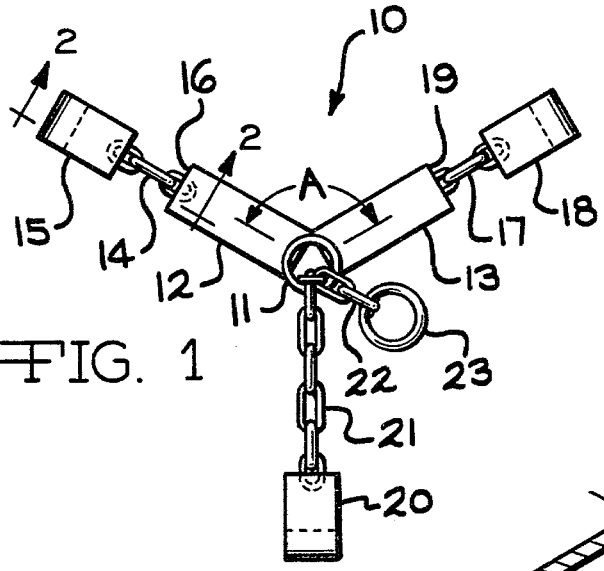
FIG. 1 is a top plan view of a drum handling implement constructed in accordance with the present invention.
Figure 2:
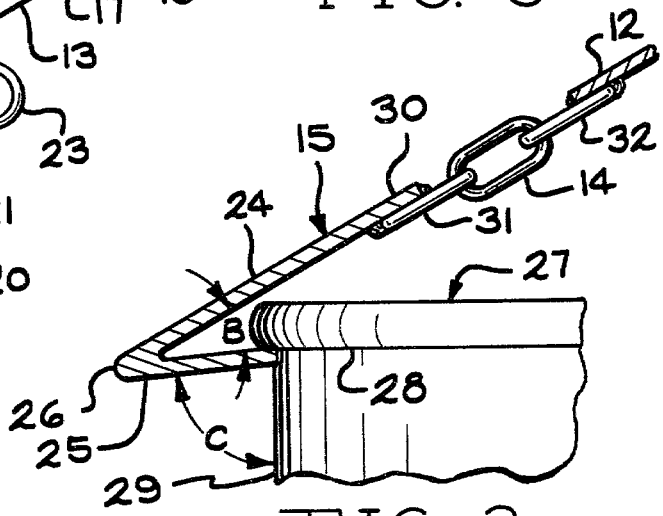
FIG. 2 is a cross-sectional view taken along line 2—2 of FIG. 1.
Figure 3:
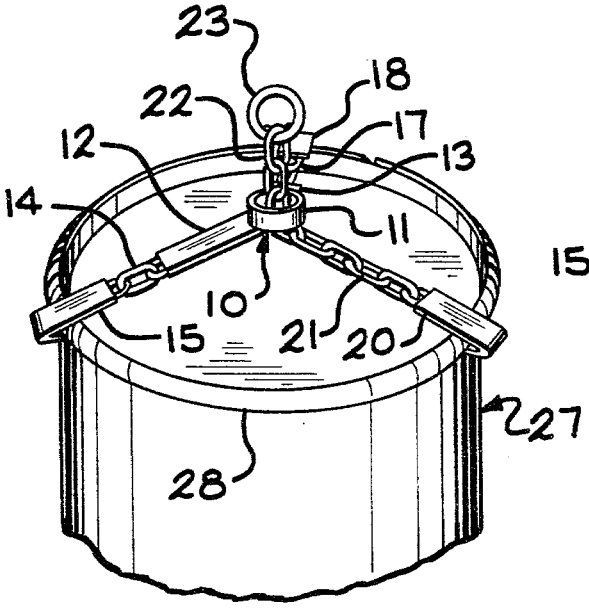
FIG. 3 is a perspective view showing the implement of FIG. 1 attached to the rim of a drum for lifting the drum.

Turning now to the drawings and particularly to FIGS. 1–3, a drum handling implement 10 is illustrated in accordance with one embodiment of the present invention. Implement 10 includes a tubular shaped collar 11 having two arms 12 and 13 welded or otherwise attached thereto. The arms 12 and 13 are fixed relative to one another at a predetermined angle A. A chain 14 connects a hook 15 to an end 16 of the arm 12 and a chain 17 attaches a hook 18 to an end 19 of the arm 13. The chains 14 and 17 serve as flexible members permitting movement of the hooks 15 and 18 relative to the arms 12 and 13. A third hook 20 is attached to one end of a chain 21. The chain 21 extends from the hook 20 to and upwardly through the collar 11 and has a free end 22. The end 22 may be connected to a ring 23 to facilitate attaching the chain end 22 to the end of a hoist cable or to some other lifting device, such as a tine on a forklift. The angle A between the arms 12 and 13 preferably is about 120°. However, the angle A may be less than 120°, such as 60°, without risk of dropping a drum lifted by the implement 10 since the drum will be engaged at three points.

FIG. 2 shows details of the hook 15 and its connection to the arm 12. Of course, it should be appreciated that the hooks 18 and 20 may be identical to the hook 15. The hook 15 includes a shank 24 and a prong 25. The prong 25 is attached to the shank 24 at a point 26 either by forming the prong 25 integrally with the shank 24 or by welding. The prong 25 extends from the shank 24 at an angle B which preferably is about 30°. Angle B is selected such that when the prong 25 engages the side of a drum 27 below a drum rim 28 and the implement 10 is used for lifting the drum 27, an angle C between the prong 25 and a side 29 of the drum 27 is 90° or less. In other words, the prong 25 extends either perpendicular to the drum side 29 or at a slight upwardly directed angle so as to firmly engage the drum side 29 and the drum rim 28. The hook shank 24 also has an end 30 which is welded or otherwise attached to a link 31 on the chain 14. Another link 32 on the chain 14 is welded or otherwise attached to the arm 12.

FIG. 3 shows the drum handling implement 10 attached to the drum 27 for lifting the drum 27. Initially, the hooks 15 and 18 are positioned to engage the drum rim 28 at points spaced substantially 120° apart, or at some other angle established by the angle A between the arms 12 and 13. It should be noted that the hooks 15 and 18 may be positioned at an angle slightly different than the angle A due to the flexibility of the chains 14 and 17. However, the hooks will be located at substantially the angle A due to the fixed positioning between the two arms 12 and 13. The hook 20 is positioned on the drum rim 28 at a location generally centered between the hooks 15 and 18. Since the drum 27 is being grasped at three points, the location of the hook 20 may deviate from an exact centering between the hooks 15 and 18 without risk of the drum 27 slipping from the implement 10. After the hook 20 is positioned on the drum rim 28, the chain 21 is tightened by lifting on the ring 23. The ring 23 may be attached to the cable of a hoist or crane or it may be attached to some other lifting device, such as the tine of a forklift.

Figure 4:
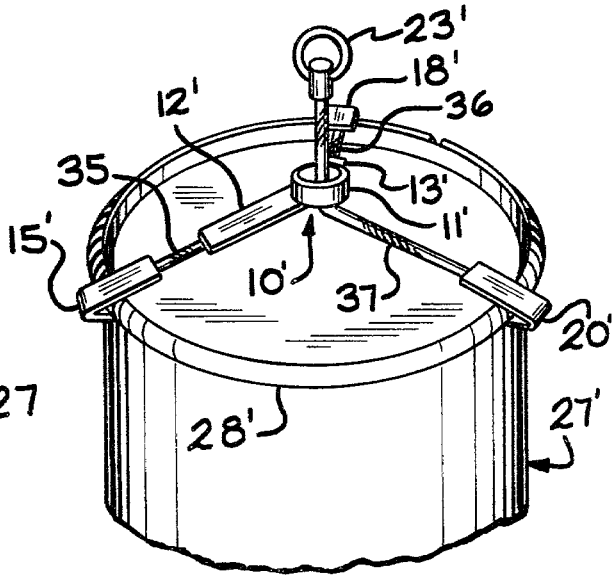
FIG. 4 is a perspective view similar to FIG. 3 and showing a modified embodiment of a drum handling implement of the present invention.

Turning now to FIG. 4, a modified drum handling implement 10' is shown. Implement 10' includes a collar 11' attached to two arms 12' and 13' which are disposed relative to each other at a fixed angle, preferably 120°. A hook 15° is attached to the arm 12' by means of a flexible cable 35 which is welded or otherwise attached to the hook 15' and to the arm 12'. Similarly, a flexible cable 36 is welded or otherwise attached to the arm 13' and to a hook 18'. A third flexible cable 37 extends from a ring 23' downwardly through the collar 11' and outwardly to a third hook 20'. The flexible cables 35 and 36 permit attachment of the hooks 15' and 18' to the drum rim 28'. The third hook 20' then is attached to the drum rim 28' at a midpoint between the hooks 15' and 18' and the ring 23' is lifted to tighten the cable 37'. When the cable 37' is tightened, the implement 10' firmly grasps the drum 27'.

Figure 5:
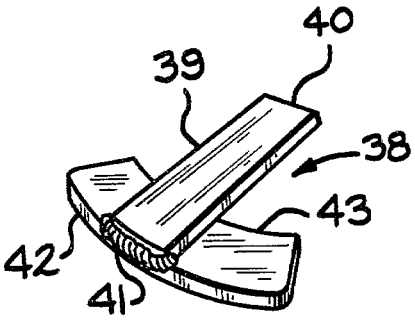
FIG. 5 is a perspective view of a modified hook for use in the implement of the present invention for engaging the rim of a drum.

The hooks shown in implements 10 and 10' in FIGS. 1–4 are provided with prongs 25 which engage the side of a drum immediately below a rim. The prongs 25 are generally rectangular in shape and may slightly deform the side of the drum immediately below its rim. Such deformation further prevents slipping of the hooks on the drum. However, where drums are to be re-used, it may be undesirable to deform the side of the drum during handling. FIG. 5 shows a modified hook 38 for the drum handling implement of the present invention. The hook 38 includes a shank 39 having an end 40 which is welded or otherwise attached to a flexible member, such as the chains 14, 17 and 21 in FIG. 1 or the cables 35, 36 and 37 in FIG. 4. The shank 39 is attached at an end 41 to a prong 42. The prong 42 is considerably wider than the shank 39 and has an arcuate edge 43 which abuts and conforms to the outer periphery of a drum immediately below the drum rim. The arcuate edge 43 has a width sufficient to distribute forces on and prevent deformation of the drum side. Furthermore, the curvature of the edge 43 helps to prevent any possible slippage of the hook 38 on the drum while the drum is being lifted and moved.

It will be appreciated that various modifications and changes may be made in the above described embodiments of a drum handling implement. For example, the hooks 15 and 18 were shown attached to the arms 12 and 13, respectively, in the implement 10 by means of chain sections 14 and 17. These chains 14 and 17 were permanently welded to the hooks 15 and 18 and to the arms 12 and 13. One or both of the welded connections on each chain may be replaced with an adjustable connection, such as a hook on each arm 12 and 13 which receive a chain link. Such an arrangement permits adjusting the spacing between the hooks 15 and 18 and the collar 11 so that the implement can be used with different sized drums, barrels or other types of containers. The third hook 20 will automatically adjust to the various sized containers when the chain 21 is tightened. Or, the hooks 15 and 18 may be attached directly to the arms 12 and 13, respectively, if desired. It also should be noted that the term "drum" as used herein includes various types to containers such as steel drums, barrels and the like. It will be appreciated that various other changes and modifications may be made in the above described preferred embodiments without departing from the spirit and scope of the following claims.

What I claim is:

1. An improved drum handling implement for engaging a drum comprising a collar having a central opening, two arms having a first end rigidly attached to said collar and a second end spaced apart from said collar, said arms extending outwardly from said central opening at a predetermined angle, a plurality of hooks each having a shank and prong means for engaging the drum, said shank and said prong means being disposed to form an interior angle of 30°, means for flexibly connecting said shank of one of said hooks to said second end of each of said arms, an elongated flexible member having a first end and a second end, said flexible member extending through said central opening in said collar, one of said hooks connected to said first end of said flexible member, and means operatively connected to said second end of said flexible member for lifting said implement, whereby said hook connected to said first end of said flexible member is drawn into secure engagement with said drum as said implement is lifted and whereby said flexible member acts against said collar as said implement is lifted to cause said hooks connected to said arms to move into secure engagement with said drum, said prong means of said hooks forming an angle of not greater than 90° with a sidewall portion of said drum positioned below said prong means to prevent said prong means from slipping on said sidewall portion of said drum during the handling of said drum.

2. An improved drum handling implement, as set forth in claim 1, and wherein said two arms extend at a predetermined angle of substantially 120°.

3. An improved drum handling implement, as set forth in claim 1, and wherein said means for flexibly connecting a shank of one of said hooks to said second end of each of said arms is a chain.

4. An improved drum handling implement, as set forth in claim 3, and wherein said means on said second end of said flexible member for lifting comprises a ring attached to said second end of said flexible member.

5. An improved drum handling implement, as set forth in claim 1, and wherein said means for flexibly connecting a shank of one of said hooks to said second end of each of said arms is a flexible cable.

6. An improved drum handling implement, as set forth in claim 1, and wherein, when said implement engages a drum, said prong means engage the drum at an upwardly directed angle.

* * * * *